US006894255B2

(12) United States Patent
Fujii et al.

(10) Patent No.: US 6,894,255 B2
(45) Date of Patent: May 17, 2005

(54) INDUCTION HEATING APPARATUS

(75) Inventors: Yuji Fujii, Kobe (JP); Kouji Niiyama, Kobe (JP); Izuo Hirota, Toyonaka (JP); Takahiro Miyauchi, Kobe (JP); Atsushi Fujita, Minoo (JP); Hirofumi Inui, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 110 days.

(21) Appl. No.: 10/382,809

(22) Filed: Mar. 5, 2003

(65) Prior Publication Data

US 2003/0178416 A1 Sep. 25, 2003

(30) Foreign Application Priority Data

Mar. 22, 2002 (JP) ..... 2002-080824
Oct. 16, 2002 (JP) ..... 2002-302296

(51) Int. Cl.[7] ..... H05B 6/12; F24H 1/00
(52) U.S. Cl. ..... 219/621; 126/373.1
(58) Field of Search ..... 219/621, 618, 219/619, 620, 622, 623; 99/DIG. 14, 451; 126/373.1–390.1

(56) References Cited

U.S. PATENT DOCUMENTS 5,150,272 A * 9/1992 Danley et al. ..... 361/144
5,386,102 A * 1/1995 Takikawa et al. ..... 219/620
5,643,485 A * 7/1997 Potter et al. ..... 219/621
5,887,018 A * 3/1999 Bayazitoglu et al. ..... 373/139
5,889,813 A * 3/1999 Fujita et al. ..... 373/156
5,893,996 A * 4/1999 Gross et al. ..... 219/447.1
6,002,118 A * 12/1999 Kawano et al. ..... 219/602
6,232,585 B1 * 5/2001 Clothier et al. ..... 219/620
6,384,387 B1 * 5/2002 Owens et al. ..... 219/601
6,504,135 B2 * 1/2003 Ablah et al. ..... 219/624

* cited by examiner

*Primary Examiner*—Daniel Robinson
(74) *Attorney, Agent, or Firm*—Sheridan Ross PC

(57) ABSTRACT

When a pan made of a non-magnetic material, such as aluminum, is used for cooking while the temperature is being controlled, a notice is made to the user to the effect that the temperature control function has been stopped and that the temperature should be manually adjusted, when the material detection section detects that the pan is made of a non-magnetic material or a pan floating phenomenon has occurred, in order to prevent abnormal increase in the temperature of the pan due to incorrect temperature detection caused by the pan floating phenomenon, a set temperature is lowered.

18 Claims, 8 Drawing Sheets

INDUCTION HEATING APPARATUS

BACKGROUND OF THE INVENTION

The present invention relates to an induction heating apparatus for use in home, restaurants, offices, factories, etc., and in particular, to an induction heating apparatus capable of heating an object to be heated made of aluminum or the like.

In an induction heating apparatus, an alternating current of a high frequency from 20 KHz to 60 KHz is made to flow through an induction heating coil (hereinafter simply referred to as heating coil) to generate a high frequency magnetic field. This high frequency magnetic field produces an eddy current in an object of heating, such as a pan, kettle or the like container placed in the vicinity of the heating coil, due to electromagnetic induction. The object to be heated is heated by Joule heat caused by the eddy current. The object to be heated is made preferably of a magnetic material, such as iron or stainless steel having magnetism, because electromagnetic induction is utilized in the induction heating. In recent years, induction heating apparatuses, such as induction heating cooking appliances, capable of heating an object to be heated of a pan, kettle or the like container (hereinafter simply referred to as pan) made of a non-magnetic material, such as aluminum or copper, have come into practical use and the scope of application of induction heating apparatuses has expanded.

In an induction heating apparatus, the direction of the eddy current generated in a pan during heating is opposite to the direction of the current that flows through the heating coil. Consequently, a repulsive force occurs between the pan and the heating coil due to magnetism. On the other hand, an electromagnetic force also works between the heating coil and the pan. In the case of the pan of a magnetic material such as iron, an attractive force due to magnetism occurs between the heating coil and the pan. In the pan made of a magnetic material, the attractive force is, in general, greater than the repulsive force, and therefore, the pan is attracted to the heating coil.

In the case of a pan made of a non-magnetic material (hereinafter referred to as a non-magnetic pan), such as aluminum or copper, however, only the repulsive force works without the above-mentioned attractive force. Therefore, in the case that the non-magnetic pan, with food therein, is so light in weight that the gravity thereof is smaller than the above-mentioned repulsive force. And a "pan floating phenomenon" occurs wherein the non-magnetic pan floats up and leaves from the heating coil due to repulsive force. When the pan floating phenomenon occurs, the pan may move on the top plate made of a heat-resistant glass plate or the like and provided above the heating coil for placing the pan. The non-magnetic pan is made of a material having a low magnetic permeability and a low electric resistivity, such as aluminum or copper. Therefore, it is necessary to make a high frequency current that is greater than in the case of an iron pan to flow through the heating coil in order to secure approximately the same amount of heat as in the case of an iron pan or the like. Consequently, the above-mentioned repulsive force becomes greater than in the case of an iron pan, and the pan floating phenomenon easily occurs.

A first prior art concerning the usage of a pan of a non-magnetic material in an induction heating cooking appliance is shown in Japanese unexamined patent publication S61 (1986)-128492. According to this first prior art, a weight sensor for detecting the weight of a pan is provided in the surface of the top plate so that the weight of the pan is detected. In addition, the high frequency current flowing through the heating coil is detected by a current transformer so that the material of the pan is detected based on this detection output. In the case that the weight of the pan, including its contents, is a predetermined value or less and the material of the pan is aluminum or copper, since the pan floating phenomenon is liable to occur, the high frequency current in the heating coil is cut away so that heating is stopped. When the weight of the pan exceeds a predetermined value and, even in the case that the material of the pan is aluminum or copper, since there is no risk of the occurrence of the pan floating phenomenon, a high frequency current is made to flow through the heating coil so that heating is carried out.

A second prior art concerning the usage of a pan of a non-magnetic material in a induction heating cooking appliance is shown in Japanese unexamined patent publication S62 (1987)-276787. According to this second prior art, the weight of the pan and the material of the pan are detected in the same manner as in the above-mentioned first prior art. In the case that the material of the pan is a non-magnetic material having a high conductivity, for instance aluminum, the frequency of the high frequency current is raised to 50 KHz (20 KHz in the case of an iron pan) so that approximately the same amount of heat as in the case of an iron pan can be gained even in the case that such a pan is used. In addition, the high frequency current flowing through the heating coil is adjusted in accordance with the weight of the pan so as to limit to a current value wherein a range in which the pan floating phenomenon does not occur.

When cooking is carried out using a pan, temperature control is carried out so that the temperature of the object to be heated in the pan is maintained at the desired value during cooking, and consequently an appropriately cooked object is obtainable without risk of burning food material (object to be cooked). In particular, in the case that cooking oil is placed in a pan in order to cook tempura (Japanese fried food), it is important to maintain the temperature of the cooking oil at an appropriate level in order to cook good taste tempura. Though temperature control during cooking is not shown in the above-mentioned first and second prior arts, an induction heating cooking appliance having such a temperature control function is in practical use.

In the induction heating cooking appliance of the above-mentioned first prior art, the high frequency current is cut when the weight of the pan including its contents is a predetermined value or less, and therefore, cooking using a non-magnetic pan cannot be carried out. A non-magnetic pan, for example, cannot be used for cooking a small amount of food material for a family of a small number of people.

In the induction heating cooking appliance of the second prior art, the current flowing through the heating coil is restricted in relation with the weight of the pan with its contents inclusive. Therefore, the user cannot cook with a light pan for a small amount of food material.

It is necessary to detect the temperature of the food material in order to control the temperature of the food material in the pan. It is not easy, however, to directly measure the temperature of the food material. Therefore, the temperature of the bottom surface of the pan is, usually indirectly measured by means of a temperature sensor and the temperature of the food material is indirectly measured. The temperature sensor is provided on the lower surface of a top plate whereon the pan is placed. The temperature of the bottom of the pan is detected by the sensor through the top plate when the pan is placed on the top plate. Correct temperature detection is carried out only when the pan makes contact with the top plate. In the case that a non-magnetic pan is used, the pan floating phenomenon may lead to a state that the pan floats and moves on the top plate shifting away from the correct position. Then, the temperature sensor cannot correctly detect the temperature of the bottom of the pan. Under such state, the temperature sensor provides a detection output indicating an erroneous low temperature to the control section, and thus the control section increases the high frequency current supplied to the heating coil, to increase the temperature. Such being the case, correct temperature control is not carried out, and there is a risk wherein the temperature of the pan and the temperature of the object to be heated may rise in an abnormal level.

A general example of a conventional induction heating cooking appliance is described with reference to FIG. 8.

In FIG. 8, a heating coil 53 is disposed below a top plate 52 which has an object 51 thereon, such as a pan to be heated. A high frequency current is supplied from an inverter circuit 55 as a heating coil output adjustment section to a heating coil 53, and the heating coil 53 carries out induction heating by applying the magnetic field caused by a high frequency alternating current to the object 51 to be heated. A temperature sensor 57 is provided at approximately the center portion of heating coil 53 so as to make contact with the lower surface of top plate 52 and detects the temperature of the center portion of object 51 to be heated via top plate 52. Detected temperature of object 51 to be heated, which has been detected by temperature sensor 57, is sent to a temperature control section 58. Temperature control section 58 controls the operation of the inverter circuit 55 so that the temperature detection value becomes equal to the control target temperature (see, for example, Japanese unexamined patent publication H7 (1995)-254483 (FIG. 1, pages 4 to 6)).

The operation of the conventional induction heating cooking appliance described above is herein described in detail.

The inverter circuit 55 as the heating coil output adjustment section rectifies, smoothes and converts the alternating current of a commercial frequency inputted from a conventional power supply (not shown) to direct current, and then converts the direct current to a high frequency current of the desired frequency. The high frequency current is supplied to the heating coil 53. The heating coil 53 generates an eddy current in the object 51 to be heated, for example, a pan magnetically coupled with heating coil 53, so that object 51 to be heated is heated with Joule heat.

When object 51 to be heated is induction heated, temperature sensor 57 detects the temperature of object 51 to be heated and temperature control section 58 controls the output of the inverter circuit 55 so that the temperature of object 51 to be heated becomes equal to the control target temperature.

In the conventional induction heating cooking appliance, heating coil 53 is generally in a spiral form, wherein the inner diameter thereof is approximately 50 mm and the outer diameter is approximately 150 mm. Heating coil 53 is placed at a distance of approximately 3 mm away below from top plate 52.

In the above-mentioned conventional induction heating apparatus, temperature control section 58 changes value of the high frequency current flowing through heating coil 53. This current is the output of inverter circuit 55, in accordance with the temperature detected by temperature sensor 57, and controls the heat output of object 51 to be heated. At this time, heating coil 53 itself emits heat, and therefore, the temperature of heating coil 53 changes in accordance with the high frequency current value flowing therethrough. Accordingly, the temperature detected by temperature detector 57 which is provided in the vicinity of heating coil 53 is affected by the temperature of object 51 to be heated, and the temperature of heating coil 53 itself. Therefore, temperature sensor 57 cannot precisely detect the temperature of object 51 to be heated, and temperature control suffers harmful influences. This is a significant problem, wherein such a structure is disadvantageous in order to achieve successful cooking when using the induction heating cooking appliance.

BRIEF SUMMARY OF THE INVENTION

An object of the present invention is to provide an induction heating cooking appliance having a temperature control function such that an abnormal temperature rise can be prevented in the case that a pan made of a non-magnetic material, e.g., aluminum, is used for cooking.

Another object of the present invention is to provide an induction heating apparatus which is capable of controlling temperature with a high precision by restricting the effects of self-heating of a heating coil and has good usability.

An induction heating cooking appliance of the present invention stops controlling of the heat output on the basis of the detection result of a temperature sensor, or changes the conditions for temperature control in the case that an object to be heated has a conductivity approximately the same as, or greater than the conductivity of aluminum. Thereby, the object to be heated is prevented from an abnormal temperature rise.

An induction heating apparatus of the present invention comprises: a top plate on which an object to be heated is placed; a first heating coil that can heat an iron-based object to be heated or an object to be heated having a conductivity approximately the same as, or greater than the conductivity of aluminum; and a second heating coil that can heat the iron-based object to be heated but cannot heat the object to be heated having a conductivity approximately the same as, or greater than the conductivity of aluminum. In another aspect, the induction heating apparatus further comprises first and second heating coil output adjustment parts for respectively supplying high frequency currents to the above-mentioned first and second heating coils. The above-mentioned induction heating apparatus further comprises a temperature sensor for detecting the temperature of the object to be heated via the above-mentioned top plate and a temperature setting part for setting the control target temperature of the object to be heated as well as a temperature control part. The above-mentioned temperature control part controls the output of the above-mentioned first and second heating coil output adjustment sections in accordance with output information from the temperature sensor and from the temperature setting part so as to control the temperature of the object to be heated to a temperature corresponding to the above-mentioned control target temperature. The above-mentioned temperature control part operates only on the iron-based object to be heated by the above-mentioned first heating coil. As described above, an object to be heated is induction-heated by means of a high frequency magnetic flux generated by the heating coil. The first heating coil has a number of windings greater than that of the second heating coil and a high frequency current flowing through the first heating coil is selected smaller than that flowing through the second heating coil for the same heat output. Accordingly, the power loss in the first heating coil is smaller than that of the second heating coil and the amount of heat emitted by the first heating coil is smaller than that of the second heating coil, and the detection value of the object to be heated detected by the temperature sensor is unsusceptible to the heat emitted by the heating coil. Therefore, it is possible to carry out accurate temperature control of an object to be heated.

An induction heating cooking appliance of the invention in accordance with Claim 1 comprises: a heating coil for induction heating a non-magnetic object to be heated having a conductivity approximately the same as, or greater than the conductivity of aluminum, and for induction heating an iron-based object to be heated; an inverter section for causing a high frequency current to flow through the above-mentioned heating coil; a temperature sensor for detecting the temperature of the object to be heated; and a temperature control section for controlling the heat output of the above-mentioned heating coil based on the detection result of the above-mentioned temperature sensor. The above-mentioned temperature control section stops temperature control based on the detection result of the above-mentioned temperature sensor, or changes the conditions for temperature control in the case that the above-mentioned temperature control section recognizes heating of a non-magnetic object to be heated having a conductivity approximately the same as, or greater than the conductivity of aluminum.

According to the invention of Claim 1, in the case that a non-magnetic object to be heated having a conductivity approximately the same as, or greater than that of aluminum is heated, control of heat output that is carried out based on the detection result of the temperature sensor is stopped or the conditions of temperature control are changed. Consequently, the pan can be prevented from abnormal rise in the temperature, in the case that a pan floating phenomenon, or the like occurs and a correct detection value is not attained from the temperature sensor.

An induction heating cooking appliance of the invention in accordance with Claim 2, further comprises a material detection section for detecting the material of which an object to be heated is made. The above-mentioned temperature control section recognizes heating of a non-magnetic object to be heated having a conductivity approximately the same as, or greater than the conductivity of aluminum based on the detection result of the above-mentioned material detection section.

According to the invention of Claim 2, the temperature control section stops the control of heat output based on the detection result of the temperature sensor, or changes the conditions for temperature control in accordance with the detection result of the material detection section. In the case that the material of an object to be heated is a non-magnetic material having the conductivity approximately the same as, or greater than that of aluminum, the material is detected, and then, the control of heat output is stopped or the conditions for temperature control are changed so as to prevent the object to be heated from an abnormal rise in the temperature.

The inductance heating cooking appliance of the invention in accordance with Claim 3 further has an object to be heated selection section for selecting whether a non-magnetic object to be heated having a conductivity approximately the same as, or greater than the conductivity of aluminum is heated, or an object to be heated that is made of another material is heated. The above-mentioned temperature control section recognizes heating of a non-magnetic object to be heated having a conductivity approximately the same as, or greater than the conductivity of aluminum based on the selection result of the above-mentioned object to be heated selection section.

According to the invention of Claim 3, the user can select with the object to be heated selection section whether the object to be heated is a non-magnetic object having a conductivity approximately the same as, or greater than that of aluminum, or is an object to be heated that is made of other material. In accordance with this selection result, the control of heat output for temperature control based on the detection result of the temperature sensor is stopped, or the conditions for temperature control are changed, therefore, the object to be heated can be prevented from an abnormal rise in the temperature in the case of use of an object to be heated made of aluminum, or the like that is not appropriate for temperature control.

The induction heating cooking appliance according to Claim 4 further comprises a positional shift detection section for detecting a floating phenomenon or a positional shift of an object to be heated. The above-mentioned temperature control section recognizes heating of a non-magnetic object to be heated having a conductivity approximately the same as, or greater than the conductivity of aluminum on the basis of the detection result of the above-mentioned positional shift detection section.

According to the invention of Claim 4, temperature control is stopped, or the conditions for temperature control are changed in the case wherein a floating phenomenon or a positional shift of an object to be heated is detected. Accordingly, an abnormal rise in the temperature of the object to be heated due to inappropriate temperature control can be prevented in the case wherein a floating phenomenon or a positional shift of an object to be heated has occurred.

The induction heating cooking appliance according to Claim 5 further comprises a reporting section for making a visual or auditory report to the user. When the above-mentioned temperature control section recognizes heating of a non-magnetic object to be heated having a conductivity approximately the same as, or greater than the conductivity of aluminum and the control of heat output based on the detection result of the temperature sensor is stopped, or the conditions for temperature control are changed, the above-mentioned reporting section informs the facts.

According to the invention of Claim 5, when the temperature control section recognizes heating of a non-magnetic object to be heated having a conductivity approximately the same as, or greater than the conductivity of aluminum and the control of heat output based on the detection result of the temperature sensor is stopped, or the conditions for temperature control are changed, the reporting section for making a visual or auditory report informs the facts to the user. Thereby, the user can understand the operating condition of the temperature control section.

The induction heating cooking appliance according to Claim 6 further comprises a reporting section for making a visual or auditory report to the user. When the above-mentioned temperature control section recognizes that a non-magnetic object to be heated having a conductivity approximately the same as, or greater than the conductivity of aluminum is heated, the above-mentioned reporting section informs the facts.

According to the invention of Claim 6, in the case wherein a non-magnetic object to be heated having a conductivity approximately the same as, or greater than the conductivity of aluminum is heated, the fact is informed to the user through display, and therefore, the user can heat and cook the object while observing heat conditions.

An induction heating cooking appliance according to the invention of Claim 7 comprises: an induction heating coil provided in the vicinity of the position wherein an object to be heated, such as a pan is placed; an inverter section for causing a high frequency current to flow through the above-mentioned induction heating coil; and a material detection section for detecting whether the above-mentioned object to be heated is made of a magnetic material or is made of a non-magnetic material having a high conductivity. The above-mentioned induction heating cooking appliance further comprises a positional shift detector for detecting a positional shift of the above-mentioned object to be heated relative to the above-mentioned induction heating coil; and a temperature sensor for detecting the temperature of the above-mentioned object to be heated in order to control the temperature of the above-mentioned object to be heated. The above-mentioned induction heating cooking appliance further comprises a control section, to which the respective detection outputs of the above-mentioned temperature sensor, the above-mentioned material detection section and the above-mentioned positional shift detection section are inputted, and for providing, to the above-mentioned inverter section, the control output that carries out temperature control of the object to be heated based on the detection output of the above-mentioned temperature sensor. The above-mentioned control section stops the operation of the above-mentioned temperature control, or changes the conditions for temperature control, when one detection signal, either a detection signal provided when the above-mentioned material detection section detects a non-magnetic object to be heated having a high conductivity, or a detection signal provided when the above-mentioned positional shift detector detects a positional shift of the object to be heated, is inputted into the control section.

According to the invention of Claim 7, when one detection signal is inputted to the control section either from the material detection section or from the positional shift detection section, the temperature control operation is stopped, or the conditions for temperature control are changed. Accordingly, the object to be heated is prevented from an abnormal rise in the temperature due to temperature control under the condition that the temperature sensor cannot correctly detect the temperature of an object to be heated.

When a pan made of a non-magnetic material such as aluminum is used and temperature control is attempted to be carried out, the temperature control function is automatically stopped, or the conditions of temperature control are changed by means of the detection output of the material detection section or of the pan floating phenomenon detection section. Accordingly, even when a pan floating phenomenon has occurred and the temperature sensor cannot correctly detect the temperature of the pan, the pan can be prevented from an abnormal rise in the temperature.

The induction heating cooking appliance of the invention according to Claim 8 comprises a display section for displaying a message informing the user that the above-mentioned control section has stopped the temperature control operation, or has changed the conditions for temperature control.

According to the invention of Claim 8, the user can realize that the temperature control operation has stopped or the conditions for temperature control have been changed by means of display of the display section, and after then, the user can continue heating and cooking by manually adjusting the temperature.

When the temperature control function has been stopped or, the conditions for temperature control have been changed, the fact is informed to the user by means of display so that the user is requested to manually adjust the temperature. Consequently, the user can realize the present condition "on" or "off" of temperature control and the subsequently necessary manual control, and after then the user can correctly use the induction heating cooking appliance.

The induction heating apparatus of the invention according to Claim 9 comprises an operating section with which the user instructs the stoppage of the temperature control operation, when the above-mentioned object to be heated is of a non-magnetic material having a high conductivity.

According to the invention of Claim 9, in the case that the user recognizes that the object to be heated is made of a non-magnetic material, the user can stop temperature control operation in advance so that the user does not receive a message by means of the display or by speech sound.

The user who knows the utilization conditions stops the temperature control function in advance, and therefore, the user escapes from reception of a message in the form of a display message or by means of speech sound.

The induction heating apparatus of the invention according to Claim 10 comprises: a top plate for placing an object to be heated; a first heating coil provided on the side opposite to the side for placing the object to be heated of the above-mentioned top plate, that can heat an iron-based object to be heated and an object to be heated having a conductivity approximately the same as, or greater than the conductivity of aluminum; and a second heating coil that can heat an object to be heated other than objects to be heated having a conductivity approximately the same as, or greater than the conductivity of aluminum and that can heat an iron-based object to be heated. The above-mentioned induction heating apparatus further comprises: first and second heating coil output adjustment sections for respectively supplying high frequency currents to the above-mentioned first and second heating coils; a temperature sensor for detecting the temperature of an object to be heated via the above-mentioned top plate; and a temperature setting section for setting a control target temperature of an object to be heated. The above-mentioned induction heating apparatus further comprises a temperature control section for controlling the output of the above-mentioned inverter in accordance with output information of the above-mentioned temperature sensor and of the above-mentioned temperature setting section so that the temperature of the object to be heated is controlled to the temperature corresponding to the above-mentioned control target temperature, and the above-mentioned control section controls only the temperature of the iron-based object to be heated by the above-mentioned first heating coil.

According to the above-mentioned induction heating apparatus, the respective heating coil output adjustment sections supply high frequency currents to the corresponding heating coils, and thereby, the respective objects to be heated can be induction heated by means of high frequency magnetic flux generated by the heating coils. The first heating coil can heat an iron-based object to be heated to a desired temperature according to the output of the first heating coil output adjustment section that supplies a desired high frequency current and can also heat an object to be heated having a conductivity approximately the same as, or greater than the conductivity of aluminum.

In the induction heating apparatus of the invention according to Claim 11, the number of windings of the first heating coil is greater than the number of windings of the second heating coil. The number of windings of the first heating coil is greater than the number of windings of the second heating coil and, thereby, the value of the high frequency current flowing through the first heating coil supplied by the corresponding heating coil output adjustment section is smaller than that flowing through the second heating coil, when the object to be heated made of the same material is heated with the same heat output.

The induction heating apparatus of the invention according to Claim 13 comprises capacitors which forms a resonator together with the first heating coil, and the capacitance of the above-mentioned capacitors can be changed. Thereby, an object to be heated having a conductivity approximately the same as, or greater than the conductivity of aluminum and object to be heated made of an iron-based material can be heated with the same heating coil.

In the induction heating apparatus of the invention according to Claim 14, the first heating coil and the first heating coil output adjustment section for supplying a high frequency current to the first heating coil are formed so as to heat either an object to be heated having a conductivity approximately the same as, or greater than the conductivity of aluminum or an iron-based object to be heated.

In the induction heating apparatus of the invention according to Claim 15, the rated output of the second heating coil output adjustment section for supplying a high frequency current to the second heating coil is greater than the rated output of the first heating coil output adjustment section for supplying a high frequency current to the first heating coil. In the case that the objects to be heated by the first and second heating coils are made of the same material, the value of the high frequency current supplied to the first heating coil becomes smaller than that supplied to the second heating coil. The rated output of the second heating coil output adjustment section is set at a value greater than that of the rated output of the first heating coil output adjustment section, and therefore, in the case that the objects to be heated by the first and second heating coils are made of the same material, the amount of self-emitting heat of the first heating coil is less than the amount of self-emitting heat of the second heating coil. Consequently, the heat due to the self-emitting heat of the first heating coil does not adversely affect temperature detection by the temperature sensor. Accordingly, temperature control at the time of induction heating by means of the first heating coil can be carried out with a high precision. In the case that high heating power is necessary, for example when boiling water or roasting food, the second heating coil having a high rated output is used, and thereby, cooking time can be reduced.

In the induction heating apparatus of the invention according to Claim 16, the above-mentioned first and second heating coils are in annular forms or in spiral forms, wherein the inner diameter of the first heating coil is greater than the inner diameter of the second heating coil. The above-mentioned temperature sensor is provided in the vicinity of the center portion of the first heating coil.

The first and second heating coils are in annular forms or in spiral forms, and therefore, the temperature of each object that is induction heated by each heating coil becomes uniform, and effects due to positional shift of the object with respect to the heating coil can be reduced. The inner diameter of the first heating coil is greater than the inner diameter of the second heating coil, and thereby, it becomes possible to place the temperature sensor at a position away from the inner periphery portion of the first heating coil in the case that the temperature sensor is placed at the approximate center of the first heating coil. Thereby, effects that the detection temperature of the temperature sensor accepts from the self-emitting heat of the first heating coil can be reduced. Therefore, it becomes possible to control the temperature of the object to be heated with precision.

In the induction heating apparatus of the invention according to Claim 17, the distance between said top plate and the first heating coil is greater than the distance between the top plate and the second heating coil. Thereby, a heat insulating barrier of air formed between the first heating coil and the top plate is thicker than a heat insulating barrier of air formed between the second heating coil and the top plate. This heat insulating barrier reduces the thermal effects provided to the top plate and the temperature sensor by the heat from the self-emitting heat of the first heating coil, and therefore, highly precise detection of the temperature of the object to be heated becomes possible by means of the temperature sensor. Thereby, temperature control of the object to be heated can be carried out with greater precision by the first heating coil.

The induction heating apparatus of the invention according to Claim 18 further comprises a cooling section for cooling the plurality of heating coil output adjustment sections for respectively supplying desired high frequency currents to the plurality of heating coils. The first heating coil is placed at a position where optimal cooling condition is attained by the cooling section. The cooling section is positioned opposite to the first heating coil for heating an object to be heated, having a conductivity approximately the same as, or greater than the conductivity of aluminum, and the first heating coil output adjustment section for supplying a desired high frequency current to this first heating coil. The cooling section intensively cools the portion having a great amount of heat emission. Thereby, the reliability of the apparatus can be enhanced. It becomes possible to reduce the thermal effects to the top plate and to the temperature sensor due to the self-emitting heat from the first heating coil by intensively applying a cooling stream of air, for example, by a cooling fan of the cooling section, to the first heating coil, rather than to the second heating coil. A position effectively receiving cooling air of the cooling fan is the position receiving the greatest amount of cooling air or the position receiving a cooling air having a temperature approximately the same as that of the intake stream of air. The thermal effects supplied to the top plate and to the temperature sensor by the self-emitting heat of the first heating coil can be reduced by providing a cooling section in the above-mentioned manner. As a result, the temperature of the object to be heated can be detected with a high precision by means of the temperature sensor, and therefore, temperature control can be precisely carried out on the object to be heated by means of the first heating coil.

According to the experiments by the inventors, in order to heat an object to be heated having a conductivity approximately the same as, or greater than the conductivity of aluminum to approximately the same degree as an object to be heated made of an iron-based material, it is necessary to increase the number of windings of the heating coil for aluminum to a number greater than the number of windings of the heating coil for heating only the object to be heated made the iron-based material. This is also necessary to reduce the self-emitting heat of the heating coil for aluminum that heats an object to be heated having a conductivity approximately the same as, or greater than the conductivity of aluminum.

According to the present invention, the number of windings of the first heating coil that can heat an object to be heated having a conductivity approximately the same as, or greater than the conductivity of aluminum is greater than the number of windings of the second heating coil that can heat an object to be heated made of an iron-based material but cannot properly heat an object to be heated having a conductivity approximately the same as, or greater than the conductivity of aluminum. In the same heat output and the same material of the object to be heated, the value of the high frequency current supplied from the heating coil output adjustment section to the first heating coil having the greater number of windings, is smaller than that supplied to the second heating coil. The amount of self-emitting heat of the first heating coil is less than that of the second heating coil under the same conditions. According to the present invention, temperature control is carried out by detecting the temperature of the object to be heated in the vicinity of the first heating coil emitting a small amount of self-emitting heat. Thereby, effect of the temperature due to the self-emitting heat of the first heating coil is reduced in the temperature control, and precise temperature control of the object to be heated becomes possible.

According to the present invention, the second heating coil having the smaller number of windings which can heat only an iron-based object to be heated is provided, and the desired high frequency current is supplied to the second heating coil by means of the second heating coil output adjustment section. The number of windings of the heating coil can be appropriately selected in accordance with the material of the object to be heated, thereby, increase in the amount of usage of Litz copper wire accompanying increase in the number of windings of the heating coils can be restricted so that increase in cost can be restricted.

Furthermore, a cooling section is provided to the first heating coil output adjustment section so as to intensively cool the portion wherein thermal stress increases. Thereby, the reliability of the apparatus is increased.

DETAILED DESCRIPTION OF THE INVENTION

Hereafter, the preferred embodiments of an induction heating cooking appliance and an induction heating apparatus according to the present invention are described in reference to FIG. 1 to FIG. 7.

[First Embodiment]

An induction heating cooking appliance having a temperature control function according to the first embodiment of the present invention is described in reference to FIG. 1 to FIG. 4.

Figure 1:
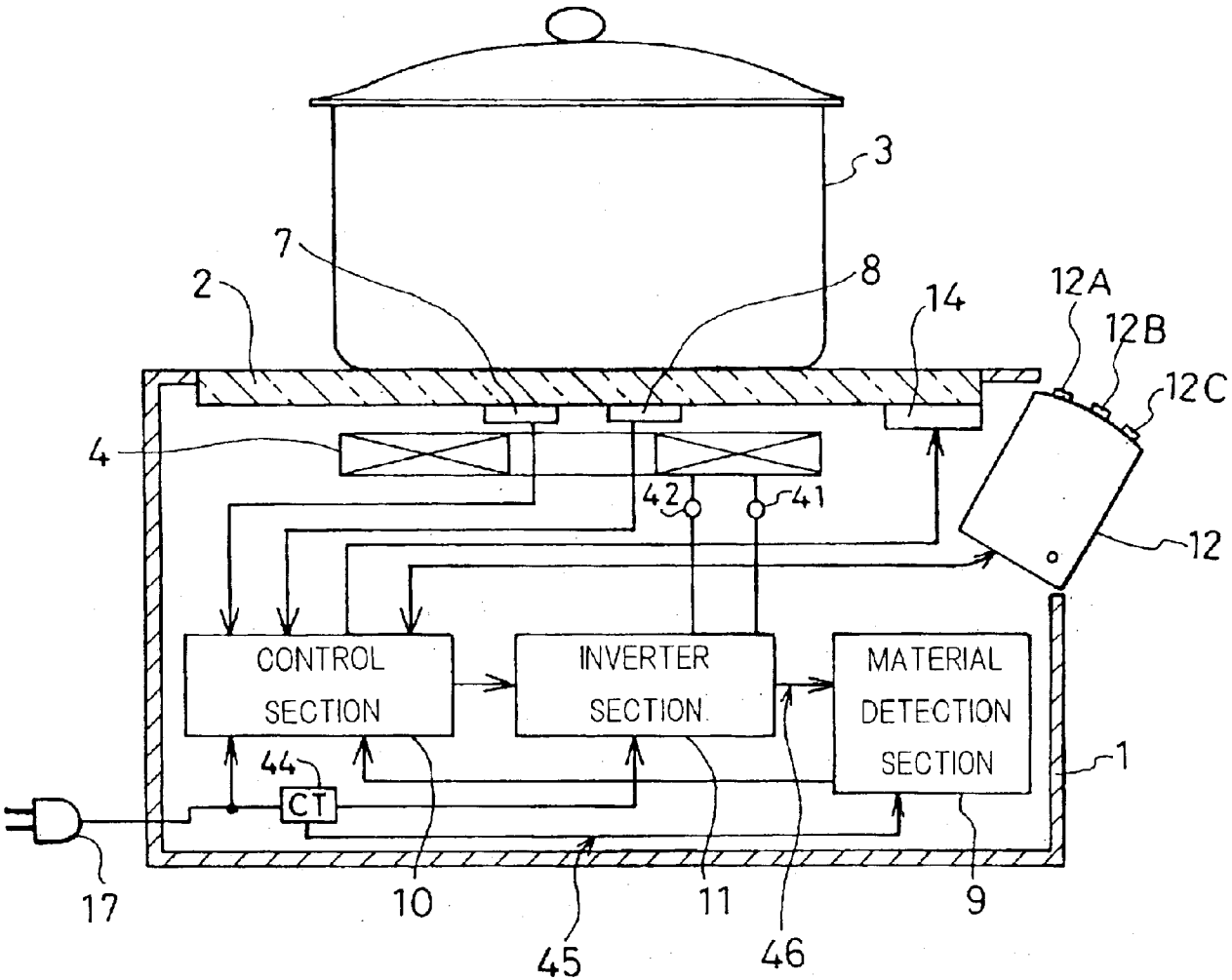
FIG. 1 is a cross sectional view showing the configuration of an induction heating cooking appliance according to the first embodiment of the present invention.

FIG. 1 is a cross sectional view of an induction heating cooking appliance of the present embodiment. In the figure, a top plate 2 made of heat-resistant glass or the like is attached to the top portion of a housing 1, and the user places a pan 3 or the like on top plate 2 to heat the pan for cooking. An induction heating coil 4 is disposed in a housing 1 beneath top plate 2 so as to keep a predetermined distance between induction heating coil 4 and pan 3. A predetermined position for placing pan 3 is indicated on the upper surface of top plate 2 with a pattern, such as a circle (not shown). A temperature sensor 7 and a pan floating detector 8 are disposed on the lower surface of top plate 2. Temperature sensor 7 detects the temperature of the bottom of pan 3 via top plate 2. Pan floating phenomenon detector 8 detects the "pan floating phenomenon," which is a phenomenon that pan 3 as an object to be heated floats from the upper surface of top plate 2. The pan floating phenomenon detector 8 also has a positional shift detection function for detecting positional shift of the pan which moves on the surface of top plate 2 and shifts from the predetermined position. The housing 1 is provided with a material detection section 9 for detecting the material of pan 3, a control section 10 and an inverter section 11. The respective detection outputs from the above-mentioned temperature sensor 7, pan floating detector 8 and material detection section 9 are sent to control section 10. An operating section 12 is disposed on a side 1A of housing 1 facing the user.

Figure 2:
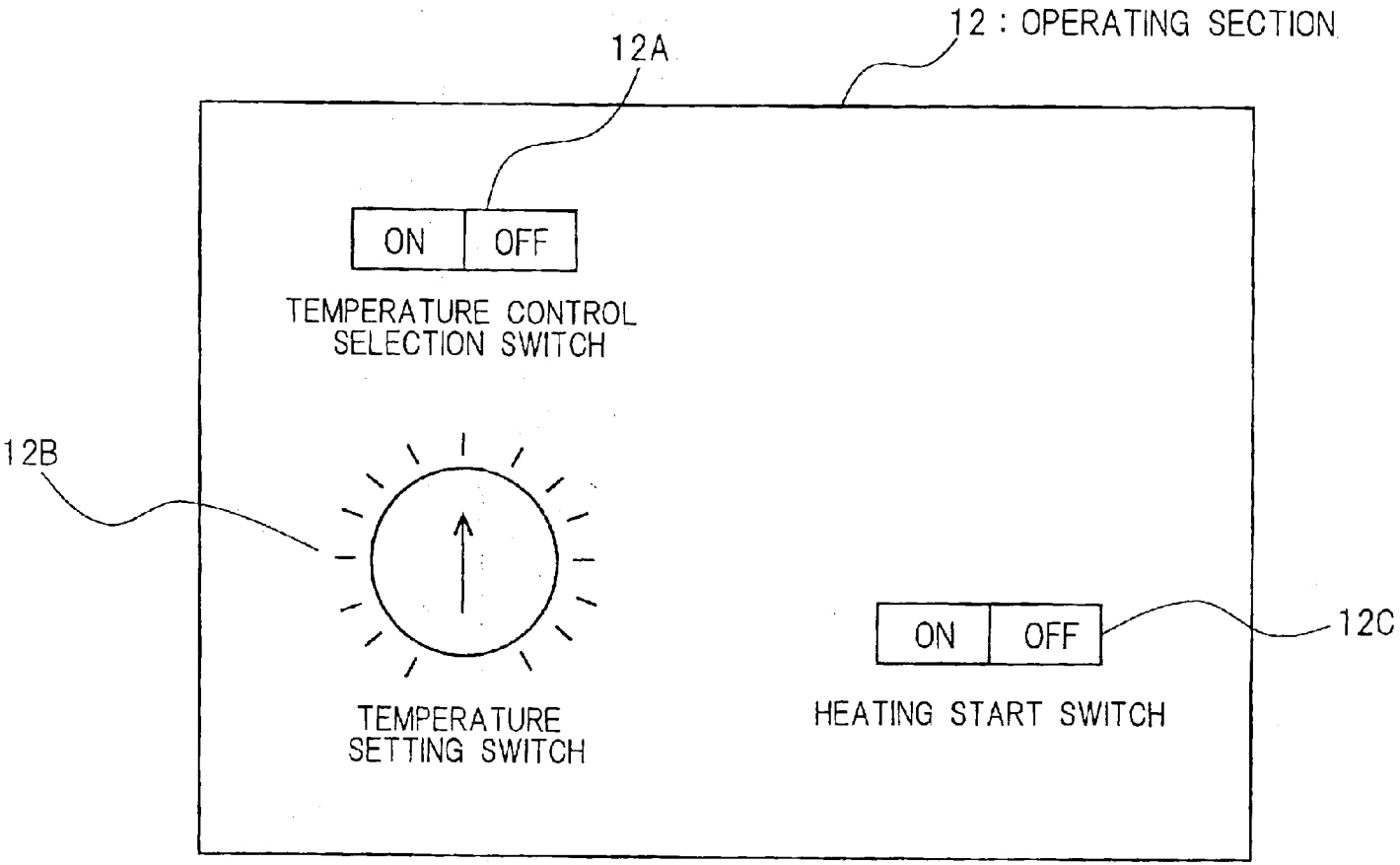
FIG. 2 is a plan view of the operation panel of operation section 12 of the induction heating cooking appliance of the first embodiment.

FIG. 2 is a front view of operating section 12. As shown in FIG. 2, operating section 12 has a temperature control selection switch 12A, a temperature setting switch 12B and a heating start switch 12C, which are connected to the control section 10. A display section 14 connected to control section 10 is disposed in the vicinity of operating section 12 of top plate 2. The output terminal of control output of control section 10 is connected to the input terminal of inverter section 11. The output terminal of inverter section 11 is connected to terminals 41 and 42 of induction heating coil 4. A current transformer 44 (hereinafter referred to as CT44) for detecting the input current of inverter section 11 is coupled to the alternating current input leads. A current signal 45 of detection output of CT44 is inputted to one of the input terminals of material detection section 9. A voltage signal 46 corresponding to the voltage value that is applied to induction heating coil 4 from inverter section 11 is inputted to the other of the input terminals of material detection section 9. Material detection section 9 detects the material of the pan based on the input current (I) and the voltage (V) of the induction heating coil corresponding to the above-mentioned current signal 45 and voltage signal 46, respectively. Control section 10 and inverter section 11 are connected to an alternating current power supply of, for example, AC100V via a power supply line 17.

The operation of the induction heating cooking appliance of the present embodiment is described hereafter. Temperature sensor 7 has a temperature detection element, such as a thermistor, so as to detect the temperature of the bottom of pan 3 when is placed at a predetermined position on top plate 2. The control section 10 includes a temperature control section for controlling the temperature of pan 3 so as to keep a temperature set by the user, on the basis of the detection output of temperature sensor 7. Pan floating phenomenon detector 8 is a proximity switch of a capacitance sensing-type, for example, and detects the pan floating phenomenon above top plate 2. Material detection section 9 is a detector for detecting whether the material of pan 3 is a magnetic material or a non-magnetic material, and detects the material of the pan based on the current of heating coil 4 and the voltage across two terminals 41 and 42, as described after in detail. Temperature control selection switch 12A is a switch used to select whether or not the user carries out temperature control or not. Temperature setting switch 12B is a switch for the user to set a heating temperature, whereby the desired temperature can be set within a predetermined range. Heating start switch 12C is a switch to switch between "on" and "off" for the operation of start of heating and completion of heating. Display section 14 is a display apparatus as a reporting section for making a report of the operational state of the induction heating cooking appliance of the present embodiment.

Figure 3:
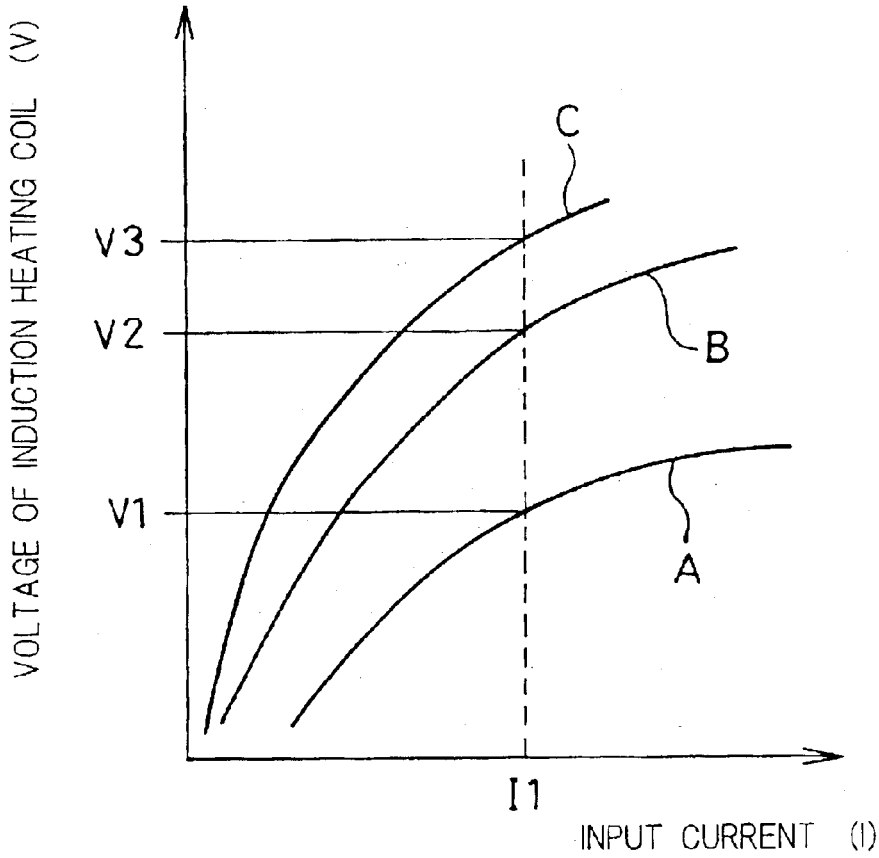
FIG. 3 is a graph of current/voltage characteristics curves for describing the known operating principle of the material detection section.

One example of the detection principle of material detection section 9 is described in the following. FIG. 3 shows the current-voltage characteristics curve of induction heating coil 4 wherein abscissa indicates the input current (I) and ordinate indicates the voltage (V) of the induction heating coil. In FIG. 3, the current voltage characteristics shown as curve A is gained in the case that pan 3 is made of iron and the current-voltage characteristics shown as curve B are gained in the case wherein pan 3 is made of stainless steel (18-8 SUS), which is a non-magnetic material having a conductivity lower than that of aluminum. In addition, the current-voltage characteristics shown as curve C are gained in the case wherein pan 3 is made of a non-magnetic material having a high conductivity, such as aluminum. In curves A, B and C of FIG. 3, the voltages V with respect to the same input current I1 are V1 in curve A, V2 in curve B and V3 in curve C. By detecting the differences among these voltages V1, V2 and V3, the material of pan 3 is determined whether the material is aluminum, non-magnetic stainless steel or an iron-based material. The above-mentioned detection principle is only one example, and other methods may be used for detection.

When the user cooks by using the induction heating cooking appliance of the present embodiment, the user first places pan 3, in which an food material is contained, at a predetermined position on the upper surface of top plate 2.

Figure 4:
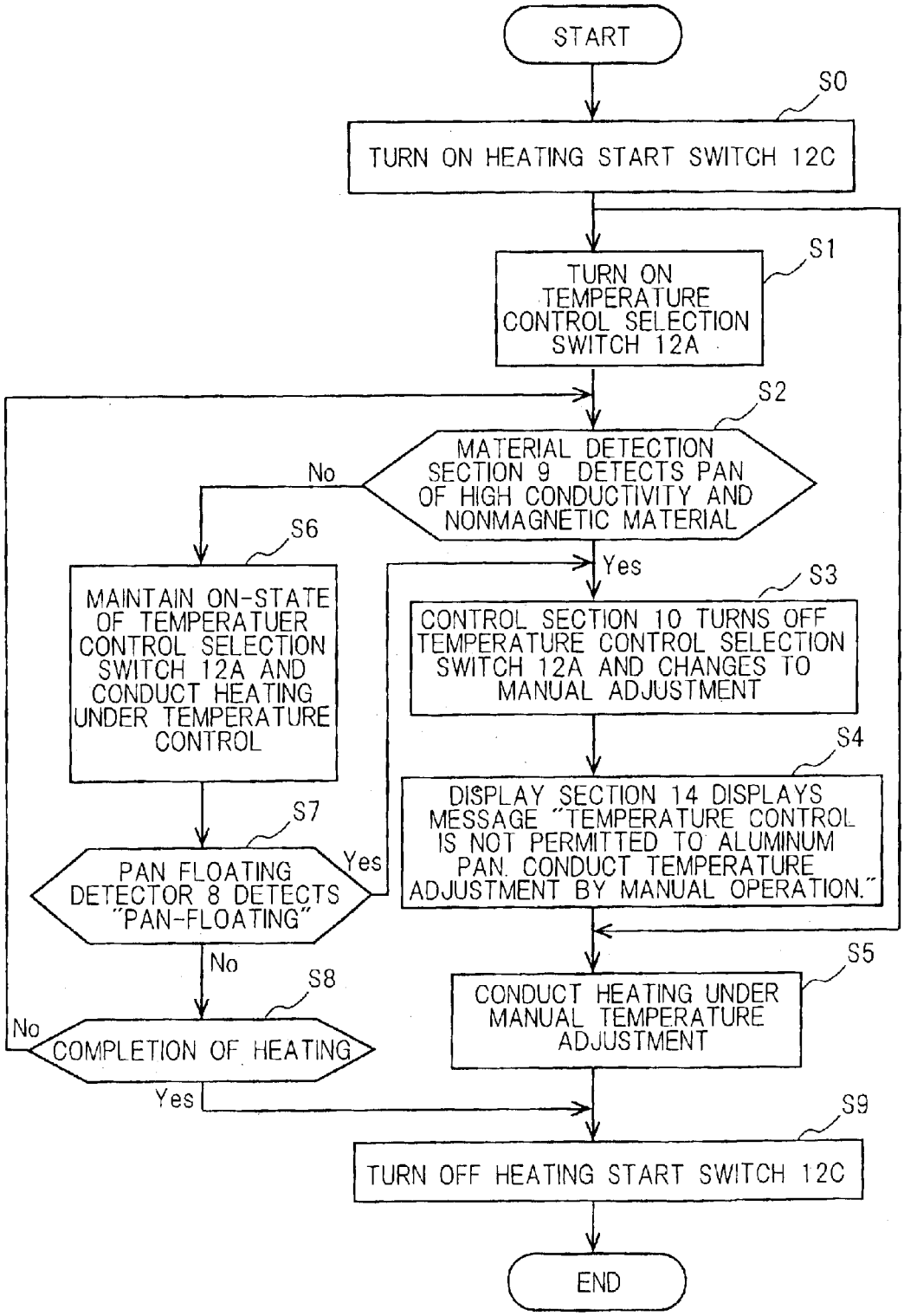
FIG. 4 is a flowchart showing the operation of the first embodiment of the induction heating cooking appliance of the present invention.

The operation of the induction heating cooking appliance of the present embodiment during cooking by the user is described in reference to flowchart of FIG. 4.

The user learns in advance "conditions of using" of the induction heating cooking appliance by reference to instruction manuals, or the like. According to one of the conditions of using, temperature control selection switch 12A of the induction heating cooking appliance of the present embodiment can be turned "on" for temperature control only in the case of using of a pan made of iron, magnetic stainless steel, or the like. The user learns other condition of using such that temperature control selection switch 12A must be turned "off" when a pan made of a non-magnetic material such as aluminum is used. Hereinafter, these conditions of using are referred to as "utilization condition." Accordingly, when a user who knows the utilization conditions uses pan 3 made of a non-magnetic material, heating is started by turning "on" heating start switch 12C in the state that temperature control selection switch 12A is turned "off" (Step S0 of FIG. 4). In this case, the temperature is manually adjusted using the temperature adjustment section having panel switches (not shown), or the like, (Step S5 of FIG. 4). In the case wherein the user uses pan 3 made of a magnetic material such as iron, temperature control selection switch 12A is turned "on" so that the temperature control function can be utilized.

when a user who does not know the above-mentioned utilization condition turns "on" temperature control selection switch 12A for temperature control to heat pan 3 made of a non-magnetic material (Step S1 of FIG. 4), material detection section 9 detects that the material of pan 3 is a non-magnetic material having high conductivity, such as aluminum or copper (Step S2 of FIG. 4), and provides a detection signal to control section 10. As a result, control section 10 automatically turns temperature control selection switch 12A "off" so that temperature control is stopped and switched to manual adjustment (Step S3 of FIG. 4). Stoppage of temperature control is referred to as "control stop." In this case, display section 14 displays a message such as "Temperature control is not permitted for aluminum pan. Conduct temperature adjustment by manual operation" (Step S4 of FIG. 4). The user may be informed by speech sound if necessary or an alarm may be set off. Consequently, the user is informed that the temperature cannot be controlled for pan 3 of a non-magnetic material, and the user then manually adjusts the temperature for cooking (Step S5 of FIG. 4). In place of automatic turning "off" of temperature control selection switch 12A by control section 10, the conditions for temperature control may be automatically changed in such a manner as the lowering of the set temperature for temperature control. Such a change in the conditions for temperature control is referred to as "condition change" for temperature control.

When pan 3 is iron or the like, and therefore, a detection signal indicating the detection of a non-magnetic material is not outputted, that is to say, "no" in Step S2, the procedure goes to Step S6, and heating is continued under predetermined conditions while the temperature is automatically controlled.

If the material detection section 9 does not operate due to a malfunction, for example, or when the pan floating phenomenon has unexpectedly occurred, pan floating detector 8 detects these states (Step S7 of FIG. 4). When the pan floating detector 8 has detected the pan floating phenomenon, the procedure goes to Step S3, and a signal indicating the pan floating phenomenon is applied to control section 10, and temperature control selection switch 12A is automatically turned "off." At this time, a display or announcement is carried out as described above to the effect that the temperature of the aluminum pan cannot be controlled "due to the pan floating phenomenon" (Step S4 of FIG. 4). In this case, temperature control selection switch 12A is turned "off" and the user must adjust manually the temperature (Step S5 of FIG. 4) and therefore, an abnormal rise in the temperature of pan 3 can be prevented even in the case that the pan floating phenomenon has occurred. When a detection output is not outputted from pan floating detector 8, heating is continued under predetermined set condition while the temperature is automatically controlled (Steps S8, S2 and S6 of FIG. 4).

As described above, heating is continued according to the predetermined set condition under the automatic temperature control.(Step S6 of FIG. 4), or the necessary heating is carried out under the manual temperature adjustment by switching control to manual temperature adjustment (Step S5 of FIG. 4). When cooking is completed, the user turns "off" heating start switch 12C and completes cooking (Step S9 of FIG. 4).

According to the present invention, when a non-magnetic object to be heated having a conductivity approximately the same as, or greater than that of aluminum is heated, control of heat output based on the detection result of the temperature sensor is stopped, or the conditions for temperature control are changed. Therefore, an abnormal temperature rise can be prevented in the case that a correct detection value is not detected by the temperature sensor due to occurrence of the pan floating phenomenon, or the like.

In addition, the temperature control section stops the control of heat output based on the detection result of the temperature sensor, or changes the set condition in accordance with the detection result of the material detection section. That is to say, in the case that the material of the object to be heated is a non-magnetic material having a conductivity approximately the same as, or greater than that of aluminum, this material is detected and control of heat output is stopped, or the set condition is changed. Therefore, an abnormal temperature rise of the object to be heated can be prevented.

When a floating phenomenon or positional shift of the object to be heated is detected, temperature control is stopped or the set condition is changed. Therefore, the object to be heated is prevented from the abnormal temperature rise due to inappropriate temperature control.

[Second Embodiment]

Figure 5:
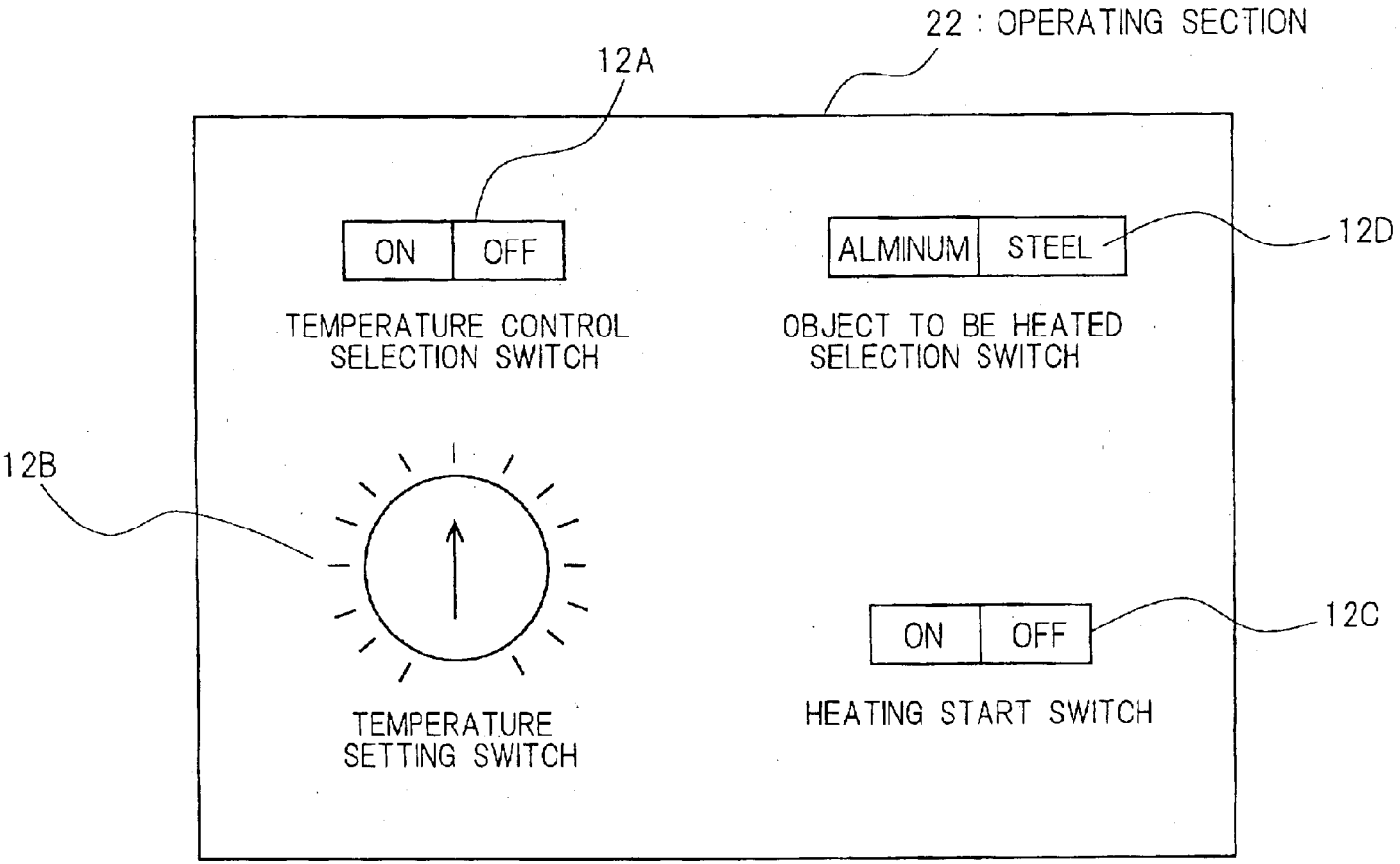
FIG. 5 is a plan view of the operation panel of operation section 22 of an induction heating cooking appliance according to the second embodiment of the present invention.
Figure 6:
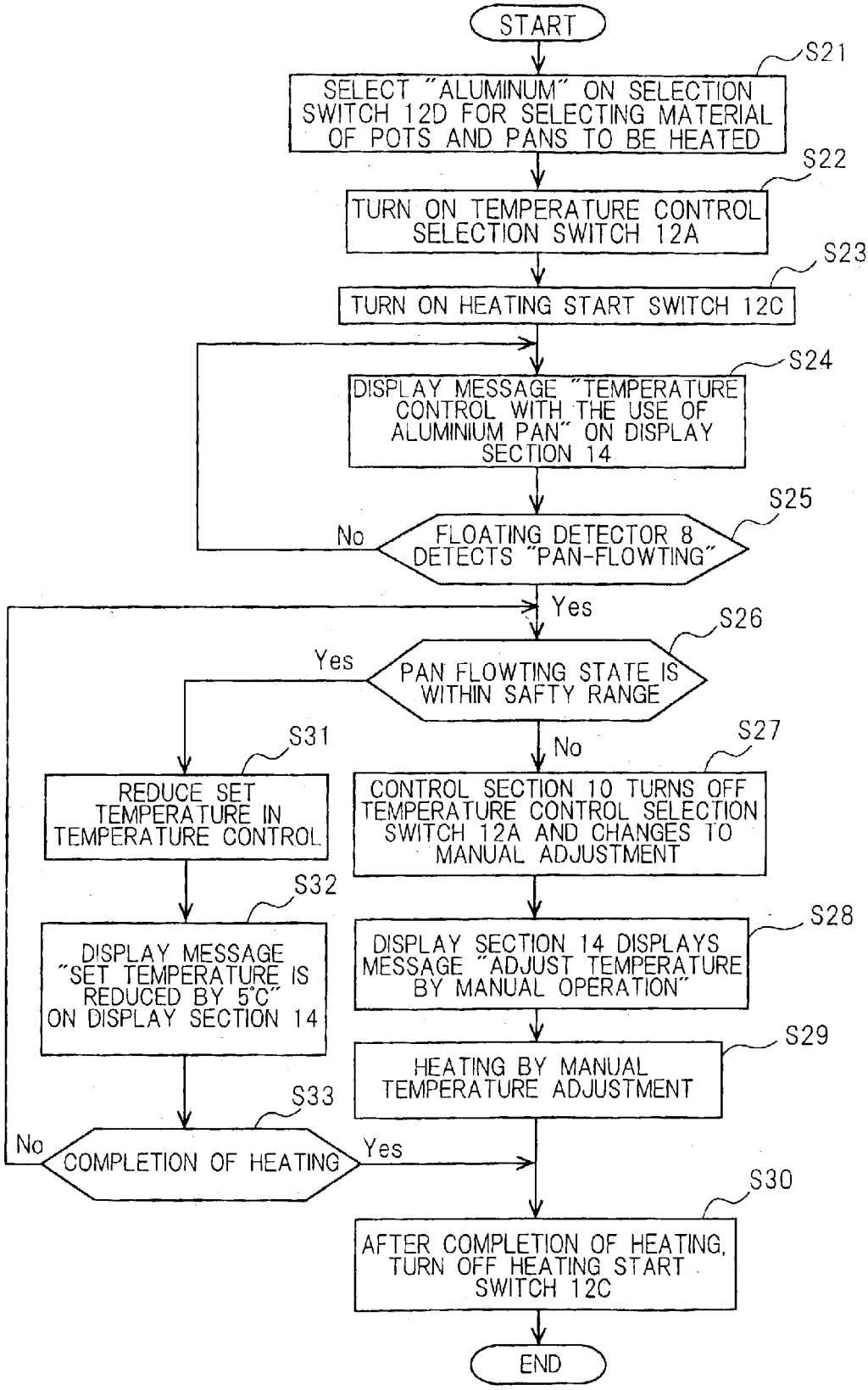
FIG. 6 is a flowchart showing the operation of the induction heating cooking appliance according to the second embodiment of the present invention.

An induction heating cooking appliance having a temperature control function according to the second embodiment of the present invention is described in reference to FIG. 1, FIG. 5 and FIG. 6. The induction heating cooking appliance of the second embodiment is provided with an operation section 22 shown in FIG. 5 in place of operating section 12 in FIG. 1. Operating section 22 is provided with an object to be heated selection switch 12D. The other parts of the configuration are substantially the same as in the first embodiment shown in FIG. 1. Object to be heated selection switch 12D is connected to control section 10 shown in FIG. 1 and control section 10 has a control function for controlling inverter section 11, as described in detail in the following.

Object to be heated selection switch 12D is a switch operated by the user which uses an object to be heated, such as pan 3 made of a material having a conductivity approximately the same as, or greater than the conductivity of aluminum (hereinafter briefly referred to as aluminum pan 3), for cooking while controlling the temperature. As described above, when aluminum pan 3 is used for cooking under the temperature control, the pan floating phenomenon or shift of the pan is liable to occur in some cases. Because of the above-mentioned fact, normal heating cannot be carried out. In the above-mentioned first embodiment, the temperature control is not activated when aluminum pan 3 is used. However, in many cases this is inconvenient. The present embodiment provides an induction heating cooking appliance which allows for safe cooking even when aluminum pan 3 is used under the temperature control.

The operation of the present embodiment is described in detail in reference to FIG. 1, FIG. 5 and FIG. 6. When the user uses aluminum pan 3 for cooking while controlling the temperature, the user makes a selection by pressing a switch button representing "aluminum" of object to be heated selection switch 12D on operating section 22 shown in FIG. 5 (Step S21 of the flowchart of FIG. 6). In addition, temperature control selection switch 12A is turned "on" (Step S22 of FIG. 6) and the desired temperature is set at temperature setting switch 12B. When heating start switch 12C is turned "on" in Step S23, the procedure goes to Step 524 and display section 14 displays "Temperature control with the use of aluminum pan." When pan floating detector 8 detects the occurrence of the pan floating phenomenon in Step S25, the procedure goes to step S26. Pan floating detector 8 detects the pan floating phenomenon on the basis of the level of its detection output and fluctuation in the level. The pan floating phenomenon has various status, for example, one side of pan 3 temporarily or continuously floats up, pan 3 moves up and down above top plate 2, or pan 3 completely floats off of top plate 2.

It is determined whether the pan floating phenomenon is within a safe range or not in accordance with a predefined reference in Step 26. Phenomena wherein a portion of pan 3 momentarily floats up or wherein the pan moves up and down to a very slight degree, for example, may be defined as being within the safe range. The phenomenon wherein pan 3 completely floats off of the top plate 2 cannot be determined to be within the safe range. When the pan floating phenomenon is not in the safe range in decision Step S26, the procedure goes to Step S27 at which temperature control selection switch 12A is automatically turned "off". Consequently, temperature control is stopped and control is changed to manual adjustment. At this time, it is preferable for the input power of the induction heating coil to slightly lower. When the pan floating phenomenon is in the safe range, the procedure goes to Step S31 and the temperature set by temperature setting switch 12B is automatically lowered. At this time, a report is made to the user by means of a display that "Set temperature is reduced by 5° C." on display section 14 (Step S32). When the set temperature for temperature control is lowered, temperature control is still carried out although the temperature is lowered. During cooking it is determined whether or not the pan floating phenomenon is in the safe range by returning to Step S26 via Step S33.

When control is changed to manual adjustment in Step S27, display section 14 displays "Adjust temperature by manual operation" (Step S28 of FIG. 6). By viewing this display, the user recognizes that the temperature is not being controlled and, subsequently, manually adjusts the temperature (Step S29 of FIG. 6). The procedure goes to Step S30 when cooking is completed. The user completes cooking by turning "off" heating start switch 12C in Step S30. It is desirable to make a report by means of letters or speech sound in Steps S24, S28 and S32. In addition, an alarm, such as a chime, may be sounded if necessary.

According to the present embodiment, the temperature can be safely controlled even when the aluminum pan 3 is used. Consequently, there is an advantage that the applicable cooking field becomes wider in the use of induction heating cooking appliance.

Although the present embodiment is described in regard to aluminum as the material of the pan, the same effects can, of course, be achieved in the case of the pan made of a non-magnetic material having a conductivity approximately the same as, or greater than that of aluminum. In addition, even in a pan made of a combination of the above-mentioned materials and other materials, the same effects can be achieved in the case that the pan has induction heating characteristics similar to those of aluminum pan.

According to the present embodiment, the user can select one of the object to be heated of a non-magnetic material having a conductivity approximately the same as, or greater than that of aluminum, and the object to be heated made of other materials by the object to be heated selection switch. In accordance with this selection result, control of heating output for temperature control based on the detection result of the temperature sensor is stopped, or the conditions for temperature control are changed by lowering the set temperature. Therefore, an abnormal temperature rise of the object to be heated can be prevented even in the case of an object to be heated made of aluminum or the like that is not suitable for temperature control.

[Third Embodiment]

Figure 7:
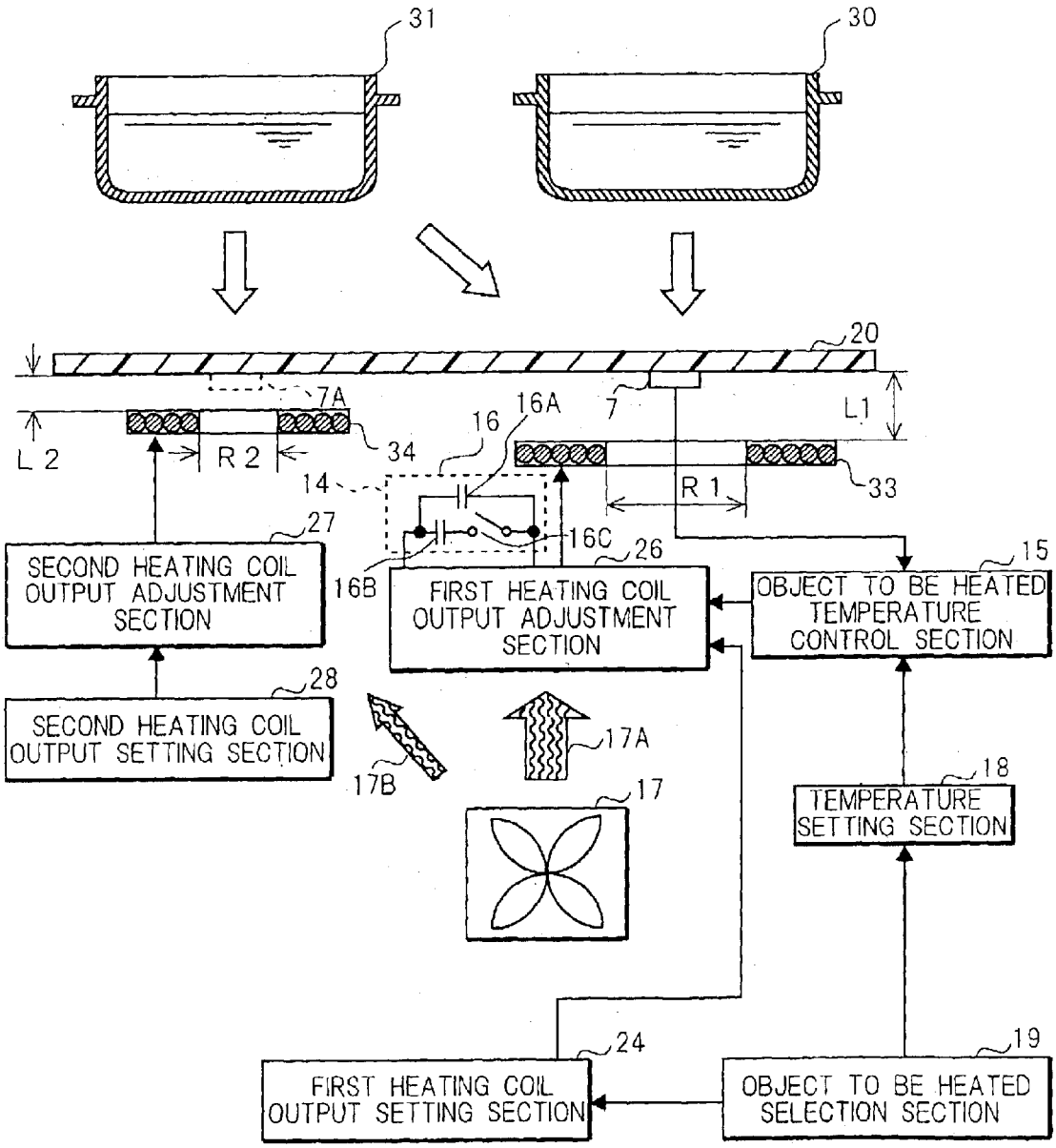
FIG. 7 is a block diagram showing the configuration of an induction heating cooking appliance according to the third embodiment of the present invention.
Figure 8:
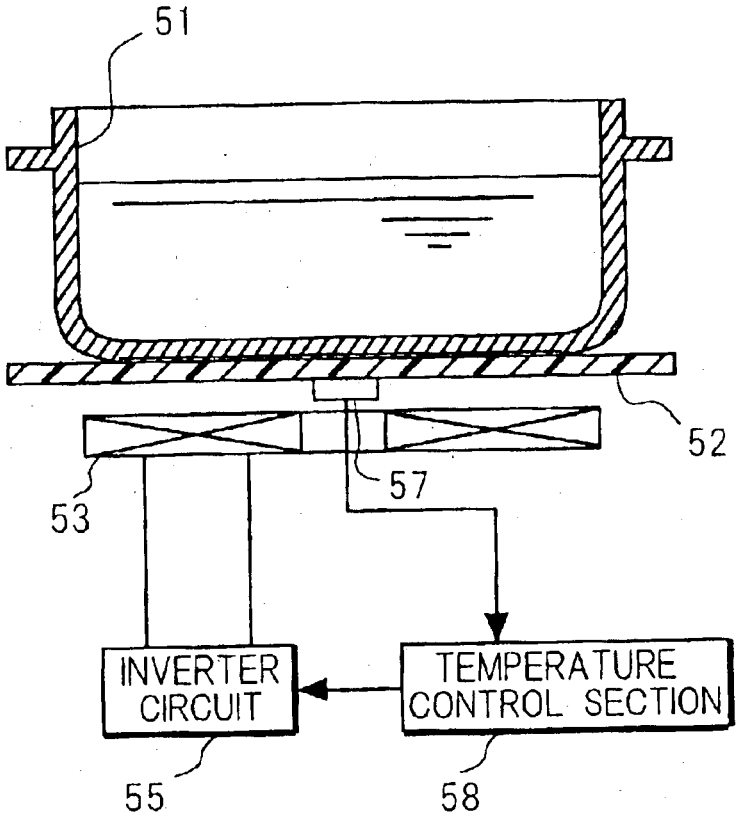
FIG. 8 is the block diagram showing the configuration of the induction heating cooking appliance according to the prior art.

FIG. 7 is a block diagram showing the configuration of an induction heating apparatus according to the third embodiment of the present invention.

In FIG. 7, the induction heating apparatus, such as an induction heating cooking appliance of the present embodiment, has a configuration of which first and second objects 30 and 31 to be heated of different types of pan with each other can be placed on a top plate 20 formed of an insulating plane plate of heat-resistant ceramic material. First object 30 to be heated is a pan made of aluminum, which is an example of an object to be heated of a material having a conductivity approximately the same as, or greater than the conductivity of aluminum. Second object 31 to be heated is a pan made of iron, which is an example of an object to be heated of an iron-based material.

Two heating coils 33 and 34 are placed beneath top plate 20. A desired high frequency current is supplied to first heating coil 33 illustrated in the right hand portion of the figure from first heating coil output adjustment section 26 (first inverter circuit). A high frequency alternating magnetic field is applied to the object to be heated, such as a pan placed on top plate 20 for induction heating, by means of first heating coil 33. Another desired high frequency current is supplied to second heating coil 34 illustrated in the left hand portion of the figure from second heating coil output adjustment section 27 (second inverter circuit). A high frequency alternating magnetic field is applied to object 31 to be heated, such as a pan placed on top plate 20 for induction heating, by means of second heating coil 34. First and second heating coils 33 and 34, respectively, are in annular forms, configured by twisting and bundling fine wires, that are further twisted to get Litz wires and by winding the Litz wires into planar forms and spiral forms.

As shown in FIG. 7, a temperature sensor 7 is provided approximately on the center axis of first heating coil 33 and on the back face of top plate 20. This temperature sensor 7 is formed of a thermistor engaged in a holder, not shown, secured to top plate 20 so that the thermistor and top plate 20 make contact without fail. Temperature information of the object to be heated located above first heating coil 30 is sensed by temperature sensor 7 via top plate 20 and is sent to object to be heated temperature control section 15.

In the induction heating apparatus of the present embodiment, first heating coil 33 is capable of heating first object 30 to be heated or second object 31 to be heated. In the configuration thereof, the frequency of the high frequency current supplied to first heating coil 33 is changed in accordance with the material of the object to be heated.

Thereby, an iron pan having a low conductivity and a high permeability, or an aluminum pan, copper pan, or the like having a high conductivity and a low permeability can be heated under the appropriate conditions. For example, when first object 30 to be heated which is a pan made of aluminum is placed on the top plate, a high frequency current of approximately 63 kHz is supplied to first heating coil 33. When second object 31 to be heated which is a pan made of iron is placed on the top plate, a high frequency current of approximately 23 kHz is supplied to first heating coil 33. This selection is made by the user with object to be heated selection section 19.

When second object 31 to be heated, which is a pan made of iron, is heated by first heating coil 33, the desired temperature is set with temperature setting section 18. Object to be heated temperature control section 15 controls the operation of first heating coil output adjustment section 26 so that the temperature of second object 31 to be heated, which is sensed via top plate 20, becomes equal to the control target temperature set by temperature setting section 18.

In the case that object to be heated selection section 19 selects that first object 30 to be heated is heated by first heating coil 33, the output of first heating coil 33 is set by first heating coil output setting section 24. The operation of first heating coil output adjustment section 26 is controlled based on this set value.

Second heating coil 34 is of a compact-type capable of heating second object 31 to be heated, which is a pan made of iron, and cannot heat first object 30 to be heated having a conductivity approximately the same as, or greater than the conductivity of aluminum. In the induction heating apparatus of the present embodiment, the output of second heating coil 34 is set by second heating coil output setting section 28 when second object 31 to be heated is heated by second heating coil 34. Second heating coil output adjustment section 27 controls the heat output of heating coil 34 based on this set output.

The induction heating apparatus of the present embodiment is provided with a cooling fan 17 as a cooling section. A cooling air from this cooling fan 17 forcibly cools first heating coil 33, first heating coil output adjustment section 26, second heating coil 34 and second heating coil output adjustment section 27. Cooling fan 17 is arranged so that greater amount of air is applied to, in particular, first heating coil 33 and first heating coil output adjustment section 26 for strong cooling. Thick arrow 17A indicates the direction of a strong air flow from cooling fan 17 and thin arrow 17B indicates the direction of a weak air flow.

The operation of the induction heating apparatus of the present embodiment configured above is described below.

First heating coil output adjustment section 26 rectifies, smoothes and converts alternating current of a commercial frequency inputted from a commercial power supply (not shown) to direct current. First heating coil output adjustment section 26 further converts the direct current to a high frequency current of the desired frequency, and then, supplies this high frequency current to first heating coil 33. First heating coil 33, to which the high frequency current is supplied, generates an eddy current in the object to be heated, such as a pan that is magnetically coupled with this first heating coil 33. Joule heat is generated due to the eddy current and the object to be heated is induction heated.

In a similar manner, second heating coil output adjustment section,27 rectifies, smoothes and converts alternating current of a commercial frequency inputted from a commercial power supply (not shown) to direct current. Second heating coil output adjustment section 27 further converts the direct current to a high frequency current of the desired frequency, and then supplies this high frequency current to second heating coil 34. Second heating coil 34, to which the high frequency current is supplied, generates an eddy current in the object to be heated, such as a pan that is magnetically coupled with this second heating coil 34. Joule heat is generated due to the eddy current and the object to be heated is induction heated.

First, description is made as to a case that second object 31 to be heated which is a pan made of iron, is heated by first heating coil 33.

Second object 31 to be heated is selected by object to be heated selection section 19, and the heating temperature of second object 31 to be heated is set at the temperature setting section 18. When the heating temperature is set, a high frequency current is supplied to first heating coil 33 from first heating coil output adjustment section 26 so that second object 31 to be heated is induction heated.

In this operation, the thermistor of temperature sensor 7 detects the temperature of second object 31 to be heated via top plate 20. Object to be heated temperature control section 15 supplies a control signal to first heating coil output adjustment section 26 to control the high frequency current to be supplied to first heating coil 33, based on temperature information detected by temperature sensor 7. In this operation, object to be heated temperature control section 15 controls first heating coil output adjustment section 26 so that the high frequency current to be supplied to first heating coil 33 has the desired value and the heat output to second object 31 to be heated is adjusted. Thereby, the temperature of second object 31 to be heated, which is being induction heated, becomes the control target temperature set by the user using temperature setting section 18.

Next, description is made as to a case that first object 30 to be heated which is a pan made of aluminum, is heated by means of first heating coil 33.

When first object 30 to be heated is selected to be heated by object to be heated selection section 19, the output of first heating coil 33 is set by first heating coil output setting section 24. When the output of first heating coil 33 is set, a high frequency current is supplied to first heating coil 33 from first heating coil output adjustment section 26 so that first object 30 to be heated is induction heated.

In this time, first object 30 to be heated is heated in accordance with the output set by the user at first heating coil output setting section 24.

A concrete example of the induction heating apparatus according to the third embodiment is described below.

The number of windings of first heating coil 33 is greater than the number of windings of second heating coil 34 so that a sufficient heat output can be realized even in the case that the material of the object to be heated has a conductivity approximately the same as, or greater than the conductivity of aluminum, and so as to reduce the self-emitting heat of first heating coil 33. Thereby, the value of the high frequency current supplied by first heating coil output adjustment section 26 is reduced. In a concrete example, the number of windings of first heating coil 33 is 43 and the number of windings of second heating coil 4 is 25. First heating coil 33 uses a Litz wire having a cross sectional area of 3.2 $mm^2$ formed by bundling 1620 fine wires (copper wires) having diameters of 0.05 mm. Second heating coil 34 uses a Litz wire having a cross sectional area of 2.8 $mm^2$ formed by bundling 40 fine wires (copper wires) having diameters of 0.3 mm.

In the case that objects to be heated made of the same material are heated with the same heat output by a heating coil, an electric power supplied to the objects to be heated is proportional to the square of the product of the high frequency current flowing through this heating coil and the number of windings of the heating coil. In the present embodiment, the number of windings of first heating coil 33 is approximately 1.7 times as great as the number of windings of second heating coil 34. Therefore, the value of the high frequency current flowing through first heating coil 33 is approximately half the value of the high frequency current flowing through second heating coil 34. Consequently, the amount of self-emitting heat of first heating coil 33 is less than the amount of self-emitting heat of second heating coil 34, even in the inclusive state of the increase of a resistance component in the first heating coil 33 which has a more number of windings than the second heating coil 34.

The induction heating apparatus of the present embodiment is configured so as to conduct the temperature control, when second object 31 to be heated of an iron-based object is heated by first heating coil 33 having a small amount of self-emitting heat. Accordingly, the self-emitting heat of first heating coil 33 is reduced and it is possible to precisely control the temperature of second object 31 to be heated.

The induction heating apparatus of the present embodiment having first and second heating coils 33 and 34 is provided with second heating coil 34, capable of heating an iron-based object to be heated but unable to heat first object 30 to be heated having a conductivity approximately the same as or greater than the conductivity of aluminum, and second heating coil output adjustment section 27 which is an output adjustment section of the second heating coil. The reason for this is described below.

Heating coil 33 for heating first object 30 to be heated has a great number of windings. If second heating coil 34 has the same number of windings as heating coil 33 so as to enable the second heating coil 34 to heat both first object 30 to be heated and second object 31 to be heated, two heating coils having great numbers of windings must be provided for heating aluminum pans which has relatively by low frequency of usage, and therefore, such configuration is uneconomical. In order to avoid this uneconomical configuration, and in order to restrict increase in the amount of usage of Litz wire due to increase in the number of windings of the heating coil, only the heating coil 33 has the large number of windings in the present embodiment. When first object 31 to be heated is heated, first heating coil 33 and first heating coil output adjustment section 26 are used, and thereby, the part having a high heat output is limited to first heating coil 33. That is to say, the apparatus is formed so that the area rising in temperature is limited and this area is intensively cooled. Thereby, it becomes possible to restrict increase in the cost of the apparatus.

In the induction heating apparatus of the present embodiment, the maximum output electric power of first heating coil output adjustment section 26, for supplying power to first heating coil 33, is 2 kW and the maximum output electric power of second heating coil output adjustment section 27, for supplying power to second heating coil 34, is also 2 kW. These respective maximum output electric power are necessary when a large iron pan, having an outer diameter of 200 mm or greater, is used.

Incidentally, second heating coil 34 may be formed so as to output the maximum output power of 3 kW. In such a configuration, the self-emitting heat does not increase in first heating coil 33 to which highly precise temperature control is required, and precise temperature detection becomes possible. In the case that higher heating power is required for boiling water or for roasting food, it is possible to use second heating coil 34 having a great maximum output and second heating coil output adjustment section 27. The induction heating apparatus of this configuration makes it possible to greatly reduce a cooking time.

Heating coils 33 and 34, respectively, are in spiral forms wherein coil wires wound in planes. The inner diameter of first heating coil 33 is greater than the inner diameter of second heating coil 34. In the concrete example, the inner diameter (R1) of first heating coil 33 is approximately 80 mm and the inner diameter (R1) of second heating coil 34 is approximately 50 mm.

In the induction heating apparatus of the present embodiment, temperature sensor 7 is disposed approximately on the center line of first heating coil 33 so as to make contact with the back surface of top plate 20. Temperature sensor 7 is placed at a position away from the inner periphery of first heating coil 33 so as not to be easily affected by the self-emitting heat of first heating coil 33. Consequently, the temperature of object 30 or 31 which is induction heated by first heating coil 30 can be precisely detected. If object 30 or 31 to be heated is placed at a position that is slightly shifted away from first heating coil 33, temperature sensor 7 can precisely detect the temperature of object 30 or 31 to be heated without being affected by the positional shift of the object to be heated.

In the induction heating apparatus of the present embodiment, distance L1 between first heating coil 33 and top plate 20 is greater than distance L2 between second heating coil 34 and top plate 20. That is to say, first heating coil 33 is placed at a position farther from top plate 20 than second heating coil 34. In the concrete example, distance (L1) in the vertical direction between first heating coil 33 and the lower surface of top plate 20 is approximately 7 mm. On the other hand, distance (L2) in the vertical direction between second heating coil 34 and the lower surface of top plate 20 is approximately 4 mm. In FIG. 7, these distances (L1 and L2) are exaggerated. A case is examined below wherein a temperature sensor 7A is provided on the back surface of top plate 20 on the center line of second heating coil 34 in the same manner as described above. The distance between first heating coil 33 and temperature sensor 7 is greater by approximately 3 mm in the vertical than the distance between second heating coil 34 and temperature sensor 7A. The inner diameter R1 of first heating coil 33 is approximately 80 mm and the inner diameter R2 of second heating coil 34 is approximately 50 mm. Therefore, the substantial minimum distance between temperature sensor 7 and the inner periphery of first heating coil 33 is greater by approximately 15 mm than the substantial minimum distance between temperature sensor 7A and the inner periphery of second heating coil 34.

In the induction heating apparatus of the present embodiment, there is a space between first heating coil 33 and temperature sensor 7 by increasing the distance therebetween as described above. An air layer exists in this space as a heat insulating barrier, and therefore, the effects of the self-emitting heat of first heating coil 33 can be reduced on the detection temperature of temperature sensor 7. Thereby, the temperature of the object to be heated by first heating coil 33 can be controlled with high accuracy.

In the induction heating apparatus of the present embodiment, cooling air from the cooling fan 17 is applied most strongly to first heating coil 33. Cooling fan 17 may be formed so as to take in air from the outside of the apparatus so that a cooling air having approximately the same temperature as the intake air, and to apply the air to first heating coil 33. In such a configuration, it becomes possible to reduce the thermal effects supplied to top plate 20 and to temperature sensor 7 by the heat from the self-emitting heat of first heating coil 33. Thereby, temperature sensor 7 can precisely detect the temperature of object 30 or 31 to be heated. The temperature of object 30 or 31 heated by first heating coil 33 can be controlled with high accuracy.

Furthermore, in the induction heating apparatus of the present embodiment, a capacitor circuit 16 which forms a resonator together with first heating coil 33 is connected to first heating coil output adjustment section 26. Capacitor circuit 16 is formed so as to change the capacitance by a switch 16C which connects capacitors 16A and 16B in parallel. In the case that object to be heated selection section 10 selects second object 31 to be heated, switch 16C is switched so that the capacitance of capacitor circuit 16 is greater than in the case of the selection of first object 30 to be heated. Excellent effects can be achieved by this switching wherein second object 31 to be heated or first object 30 to be heated can be heated at the desired temperature by first heating coil 33.

Incidentally, in this embodiment, description is made as to an example of an induction heating apparatus having two sets of heating sections, first heating coil 33 and first heating coil output adjustment section 26 as well as second heating coil 34 and second heating coil output adjustment section 27. However, the present invention is not limited to this configuration, but rather the same effects as in the above-mentioned embodiment can be achieved in induction heating apparatuses having a greater number of heating sections in accordance with conditions of utilization.

What is claimed is:

1. An induction heating apparatus comprising:

a heating coil for induction heating a non-magnetic object to be heated having a conductively approximately the same as, or greater than the conductivity of aluminum and for induction heating an iron-based object to be heated;

an inverter section for causing a high frequency current to flow through said induction heating coil;

a temperature sensor for detecting the temperature of said object to be heated;

a temperature control section for controlling the temperature by adjusting the heat to output of said heating coil based on the detection result of said temperature sensor, and a material detection section for detecting the material of which an object to be located is made, wherein said temperature control section stops temperature control based on the detection result of said temperature sensor, or changes the conditions for temperature control in the case that said temperature control section recognizes heating of a non-magnetic object to be heated having a conductivity approximately the same as, or greater than the conductivity of aluminum; and said temperature control section recognizes heating of a non-magnetic object to be heated having a conductivity approximately the same as, or greater than the conductivity of aluminum on the basis of the detection result of said material detection section.

2. The induction heating apparatus according to claim 1, further comprising an object to be heated selection section for selecting whether a non-magnetic object to be heated having a conductivity approximately the same as, or greater than the conductivity of aluminum is heated, or an object to be heated that is made of another material is heated, wherein said temperature control section recognizes heating of a non-magnetic object to be heated having a conductivity approximately the same as, or greater than the conductivity of aluminum on the basis of the selection result of said object to be heated selection section.

3. The induction heating apparatus according to claim 1, further comprising a positional shift detection section for detecting a floating phenomenon or a positional shift of an object to be heated, wherein said temperature control section recognizes heating of a non-magnetic object to be heated having a conductivity approximately the same as, or greater than the conductivity of aluminum on the basis of the detection result of said positional shift detection section.

4. The induction heating apparatus according to claim 1, further comprising a reporting section for making a visual or auditory report to the user, wherein when the temperature control section recognizes facts that a non-magnetic object to be heated having a conductivity approximately the same as, or greater than the conductivity of aluminum is heated, and control of heat output based on the detection result of the temperature sensor is stopped, or the conditions for temperature control are changed, said reporting section informs the facts.

5. The induction heating apparatus according to claim 1, further comprising a reporting section for making a visual or auditory report to the user, wherein when said temperature control section recognizes fact that a non-magnetic object to be heated having a conductivity approximately the same as, or greater than the conductivity of aluminum is heated, said reporting section informs the facts.

6. An induction heating apparatus comprising:

an induction heating coil provided in the vicinity of the position wherein an object to be heated such asa pan is placed;

an inverter section for causing a high frequency current to flow through said induction heating coil;

a material detection section for detecting whether said object to be heated is made of a magnetic material or is made of a non-magnetic material having a high conductivity;

a positional shift detector for detecting a positional shift of said object to be heated relative to said induction heating coil;

a temperature sensor for detecting the temperature of said object to be heated in order to control the temperature of said object to be heated; and a control section, to which the respective detection outputs of said temperature sensor, said material detection section and said positional shift detection section are inputted, for providing to said inverter section the control output that carries out temperature control of the object to be heated based on the detection output of said temperature sensor, and for stopping the operation of said temperature control, or for changing the conditions for temperature control, when one detection signal of a detection signal provided by said material detection section detecting a non-magnetic object to be heated having a high conductivity and a detection signal provided by said positional shift detector detecting a positional shift of the object to be heated, is inputted into said control section.

7. The induction heating apparatus according to claim 6, further comprising a reporting section for informing to a user facts that said control section has stopped the temperature control operation or changed the conditions for temperature control.

8. The induction heating apparatus according to claim 6, further comprising an operating section by which a user instructs the stoppage of the temperature control operation when said object to be heated is of non-magnetic material having a high conductivity.

9. The induction heating apparatus according to claim 6, wherein the change in the conditions for temperature control carried out by said control section is to lower the temperature to be set.

10. An induction heating apparatus comprising:

a top plate on which an object to be heated is placed;

a first heating coil, provided on the side of said top plate opposite to a side placing an object to be heated, being capable of heating an iron-based object to be heated and an object to be heated having a conductivity approximately the same as, or greater than the conductivity of aluminum;

a second heating coil being capable of heating objects to be heated other than objects to be heated having a conductivity approximately the same as, or greater than the conductivity of aluminum and an iron-based object to be heated;

a first heating coil output adjustment section and a second heating coil output adjustment section for respectively supplying high frequency currents to said first heating coil and to said second heating coil;

a temperature sensor for detecting the temperature of an object to be heated via said top plate;

a temperature setting section for setting a control target temperature of an object to be heated; and a temperature control section for controlling the outputs of said first and second output adjustment sections in accordance with the output information from said temperature setting section so that the temperature of an object to be heated is controlled to the temperature corresponding to said control target temperature, wherein said temperature control section operates only when an iron-based object to be heated is heated by means of said first heating coil.

11. The induction heating apparatus according to claim 10, characterized in that said first heating coil has a number of windings greater than that of said second heating coil.

12. The induction heating apparatus according to claim 10, further comprising a plurality of capacitors, connected to said first output adjustment section to form a resonator with said first heating coil, and a switching section for switching the capacitance of said plurality of capacitors.

13. The induction heating apparatus according to claim 11, wherein said first heating coil output adjustment section for supplying a high frequency current to said first heating coil is formed so that the first heating coil output adjustment section can heat either an object to be heated having a conductivity approximately the same as, or greater than the conductivity of aluminum or an iron-based object to be heated.

14. The induction heating apparatus according to claim 10, characterized in that the rated output of said second heating coil output adjustment section for supplying a high frequency current to said second heating coil is greater than the rated output of said first heating coil output adjustment section for supplying a high frequency current to said first heating coil.

15. The induction heating apparatus according to claim 10, characterized in that said first and second heating coils are in annular forms or in spiral forms, wherein the inner diameter of said first heating coil is greater than the inner diameter of said second heating coil, and in that said temperature sensor is provided in the vicinity of the center portion of said first heating coil.

16. The induction heating apparatus according to claim 10, characterized in that the distance between said top plate and said first heating coil is greater than the distance between said top plate and said second heating coil.

17. The induction heating apparatus according to claim 10, characterized by further comprising a cooling section for cooling the plurality of heating coil output adjustment sections for respectively supplying desired high frequency currents to said plurality of heating coils, wherein said first heating coil is placed at a position wherein the cooling effects due to said cooling section are of the maximum.

18. The induction heating apparatus according to claim 1, wherein the change in the conditions for temperature control carried out by said control section is to lower the temperature to be set.

* * * * *